US007605336B2

(12) United States Patent
Kosht et al.

(10) Patent No.: US 7,605,336 B2
(45) Date of Patent: Oct. 20, 2009

(54) PRESSURE SWITCH WITH ADJUSTABLE DIFFERENTAL SETTING

(75) Inventors: Danial L. Kosht, Gaylord, MI (US); Joseph M. Walling, Boyne City, MI (US); Richard P. Bunge, Boyne City, MI (US); Ron Hickman, Sherman, IL (US)

(73) Assignee: Honeywell International Inc., Morristown, NJ (US)

( * ) Notice: Subject to any disclaimer, the term of this patent is extended or adjusted under 35 U.S.C. 154(b) by 134 days.

(21) Appl. No.: 11/847,977

(22) Filed: Aug. 30, 2007

(65) Prior Publication Data

US 2009/0057125 A1 Mar. 5, 2009

(51) Int. Cl.
*H01H 35/40* (2006.01)

(52) U.S. Cl. ..... 200/83 SA; 200/83 J

(58) Field of Classification Search ..... 200/83 J, 200/83 P, 83 S, 83 SA, 81 R–81.9 HG, 83 R, 200/82 R–82 E See application file for complete search history.

(56) References Cited

U.S. PATENT DOCUMENTS

| | | | | |
|---|---|---|---|---|
| 3,764,763 | A | 10/1973 | Barnes | |
| 4,626,636 | A * | 12/1986 | Hickman et al. | 200/83 P |
| 4,724,289 | A * | 2/1988 | Heissler | 200/82 R |
| 4,827,093 | A | 5/1989 | Strzodka | |
| 5,155,310 | A | 10/1992 | Goans | |
| 5,252,792 | A | 10/1993 | Joyce | |
| 5,317,954 | A | 6/1994 | Goans | |
| 5,744,771 | A * | 4/1998 | Ellett | 200/83 J |
| 5,990,428 | A | 11/1999 | Hayashi et al. | |
| 6,495,777 | B1 | 12/2002 | Chou | |
| 6,705,813 | B2 | 3/2004 | Schwab | |
| 6,881,913 | B1 * | 4/2005 | Mathewes | 200/82 R |
| 7,038,151 | B2 * | 5/2006 | Amaduzzi | 200/82 R |
| 7,157,653 | B1 * | 1/2007 | Cahill | 200/82 E |
| 7,328,719 | B2 * | 2/2008 | Madden | 137/554 |
| 7,351,926 | B2 * | 4/2008 | Hillman | 200/81 R |

FOREIGN PATENT DOCUMENTS

| | | |
|---|---|---|
| JP | 59-082935 | 6/1984 |
| JP | 06-048731 | 12/1994 |
| JP | 07-230746 | 8/1995 |
| JP | 08-273506 | 10/1996 |
| JP | 2000009571 A | 1/2000 |

* cited by examiner

*Primary Examiner*—Michael A Friedhofer
*Assistant Examiner*—Lisa N Klaus
(74) *Attorney, Agent, or Firm*—Ingrassia Fisher & Lorenz, P.C.

(57) ABSTRACT

A pressure switch includes a piston that is movably disposed in a sensor housing. The piston moves, in response to a media pressure being applied to a surface thereof, between at least a first piston position and a second piston position. A conical disc spring supplies a non-linear spring force to the piston, and exhibits a spring force hysteresis. A switch engages the piston and is moved between first and second switch states by the piston. The switch exhibits a switch hysteresis. The spring force hysteresis and switching hysteresis are individually adjustable and together may be used to adjust the overall hysteresis of the pressure switch.

17 Claims, 3 Drawing Sheets

PRESSURE SWITCH WITH ADJUSTABLE DIFFERENTAL SETTING

TECHNICAL FIELD

The present invention generally relates to pressure switches and, more particularly, to pressure switches with increased adjustability to the differential settings.

BACKGROUND

Pressure switches are used in myriad systems and environments to sense a media pressure and, when the sensed media pressure attains a predetermined media pressure value, to change a switch state or states. The switch state change can then be used to cause particular desired action such as, for example, the energization or deenergization of an alert, a pump, or a valve actuator.

Most pressure switches typically include a pressure sensitive mechanism and a resiliently biased switch. One particular type of pressure switch is implemented using a spring-loaded piston as the pressure sensitive mechanism. The spring supplies a pre-load to the piston that urges the piston toward a first position. With this pressure switch, when a media pressure applied to the piston supplies a force that exceeds the preload force of the spring, the piston begins moving away from the first position. If the media pressure continues to increase, the piston will contact the resilient switch, and begin urging the resilient switch from an initial state (e.g., either open or closed) toward a second switch state (e.g., either closed or open). If the media pressure continues to increase and attains or exceeds a predetermined pressure magnitude, the piston will move the resilient switch to a second position.

Thereafter, if the media pressure decreases, the piston will begin moving, with the assistance of the spring, from the second position toward the first position. If the media pressure continues to decrease, at one or more predetermined pressure magnitudes the switch will move from its second switch state to its initial switch state and the piston will move back to its first position.

Preferably, pressure switches, such as the one described above, are configured to exhibit some level of pressure switching hysteresis. That is, a difference in the pressure-increasing and pressure-decreasing set points. Historically, pressure switches have used snap-action Belleville washer springs to implement this hysteresis. However, this typically requires the various mechanical components that comprise the pressure switch to be held to relatively tight tolerances, which can increase overall manufacturing costs. Moreover, the adjustability of the hysteresis of present pressure switches is either relatively small or non-existent.

Hence, there is a need for a pressure switch that is configured to exhibit pressure switching hysteresis and that does not rely on relatively tight tolerances for the components that comprise the pressure switch and/or allows for greater adjustability of the pressure switching hysteresis. The present invention addresses one or more of these needs.

BRIEF SUMMARY

In one embodiment, and by way of example only, a pressure switch includes a housing, a piston, and a conical disc spring. The housing has a piston cavity formed therein. The piston is movably disposed in the piston cavity and is movable, in response to a media pressure being applied to a surface thereof, between at least a first piston position and a second piston position. The conical disc spring is disposed in the housing and supplies a non-linear spring force to the piston that at least inhibits movement of the piston to the second piston position until the media pressure is greater than or equal to a predetermined set pressure value, and inhibits movement of the piston to the first piston position until media pressure is less than or equal to a predetermined preset pressure value.

In another exemplary embodiment, a pressure switch includes a housing, a piston, and a conical disc spring. The housing has a piston cavity formed therein. The piston is movably disposed in the piston cavity and is movable, in response to a media pressure being applied to a surface thereof, between at least a first piston position and a second piston position. The conical disc spring is disposed in the housing and supplies a preload force to the piston when the piston is in the first piston position. The conical disc spring is configured to exhibit a spring force hysteresis associated with movement of the piston from the first piston position to the second piston position and from the second piston position to the first piston position. The conical disc spring is further configured to supply a non-linear spring force to the piston that at least inhibits movement of the piston to the second piston position until the media pressure is greater than or equal to a predetermined set pressure value, and at least inhibits movement of the piston to the first piston position until media pressure is less than or equal to a predetermined preset pressure value.

In yet another exemplary embodiment, a pressure switch includes a housing, a piston, a switch, and a conical disc spring. The housing has a piston cavity formed therein. The piston is movably disposed in the piston cavity and is movable, in response to a media pressure being applied to a surface thereof, between at least a first piston position and a second piston position. The switch is disposed within the housing and engages at least a portion of the piston. The switch is movable between a first switch state and a second switch state in response to movement of the piston between the first piston position and the second piston position, respectively. The conical disc spring is disposed in the housing and supplies a preload force to the piston when the piston is in the first piston position. The conical disc spring is further configured to supply a non-linear spring force to the piston that at least inhibits movement of the piston to the second piston position until the media pressure is greater than or equal to a predetermined set pressure value, and at least inhibits movement of the piston to the first piston position until media pressure is less than or equal to a predetermined preset pressure value.

Furthermore, other desirable features and characteristics of the pressure switch will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
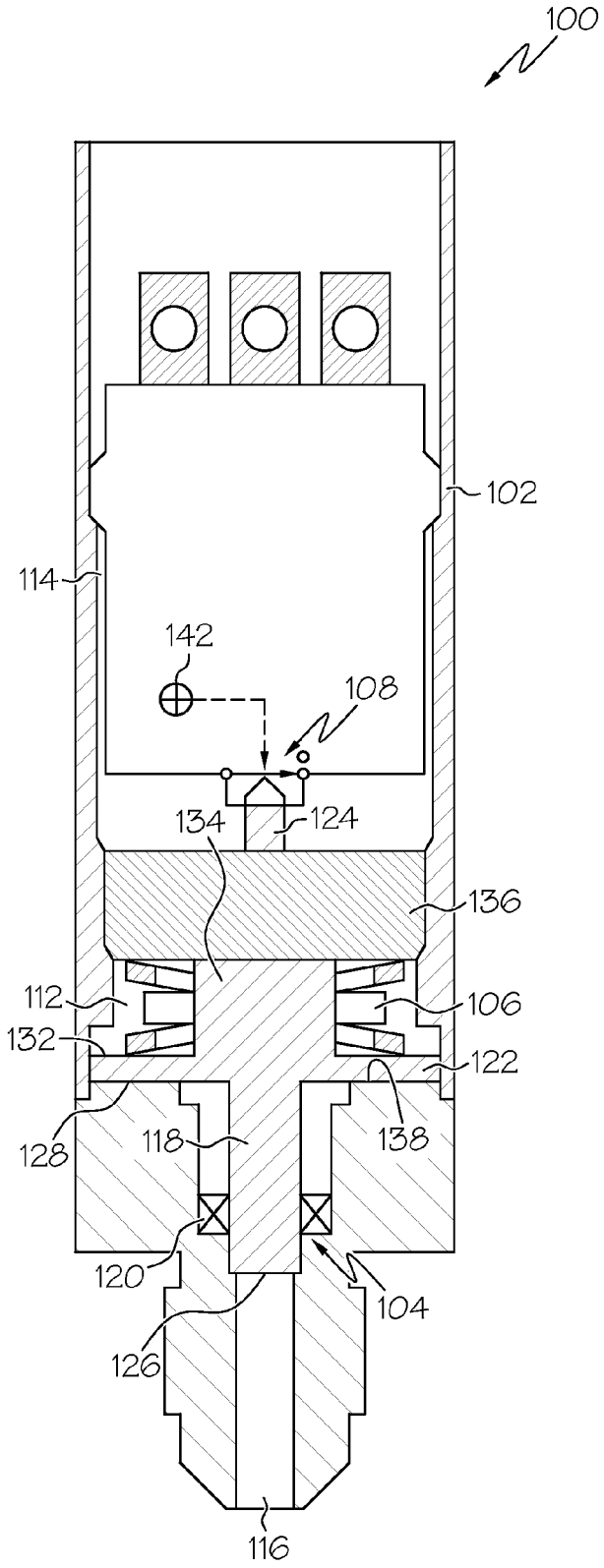
FIG. 1 is a simplified cross section view of an exemplary pressure switch assembly according to one embodiment of the present invention.

Referring to FIG. 1, a simplified cross section view of an exemplary embodiment of a pressure switch assembly 100 is depicted, and includes a housing 102, a piston 104, a conical disc spring 106, and an adjustable differential switch 108. The housing 102 has at least a piston cavity 112 formed therein. The housing 102 also preferably includes at least a differential switch cavity 114, and a media passageway 116 that is in media communication with the piston cavity 112.

The piston 104 is movably disposed within the piston cavity 112 and moves in response to media pressure in the media passageway 116. In the depicted embodiment, the piston 104 includes a first section 118, a second section 122, and a third section 124. The piston first section 118 is substantially cylindrical in shape and extends into the media passageway 116. The piston first section 118 defines an end surface 126 to which the media pressure in the media passageway 116 is applied. A seal 120 is disposed within the piston cavity 112 and surrounds the piston first section 118. The seal 120 isolates the piston cavity 112 from the media passageway 116.

The piston second section 122 is coupled to the piston first section 118 and includes a first surface 128 and an opposing second surface 132. The first surface 128 is coupled to the piston first section 118, and the second surface 132 defines a spring hub 134 and a spring seating surface. The piston third section 124 is configured similar to the piston first section 118 and extends from the spring hub 134 toward the differential switch 108. More specifically, and as FIG. 1 further depicts, the piston third section 124 extends through an adjustable spring retainer 136, which is described in more detail further below, and engages the differential switch 108.

Before proceeding further, it was noted above that the piston 104 moves in response to media pressure being applied to the end surface 126 of the piston first section 118. More specifically, the piston 104 is responsive to this media pressure to move between at least a first position and a second position. The first position is the position depicted in FIG. 1. In this position, the first surface 128 of the piston second section 122 seats against a seating surface 138 defined by the housing 102. In the second position, the first surface 128 of the piston second section 122 is displaced from the housing seating surface 138. The specific amount of displacement may vary, but is an amount that corresponds to a set pressure value, the details of which are described in more detail further below.

Figure 2:
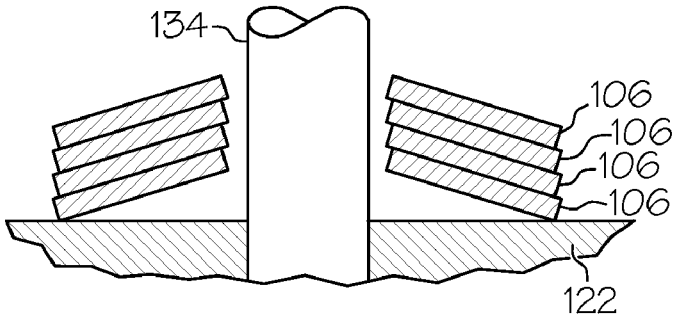
FIGS. 2 and 3 depict a plurality of conical disc springs stacked in a parallel configuration and series configuration, respectively.
Figure 3:
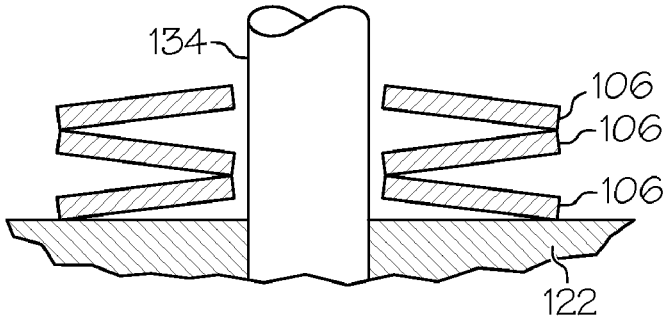

Turning now to the conical disc spring 106, this component is also disposed within the housing 102, and supplies a nonlinear spring force to the piston 104. More specifically, the conical disc spring 106 surrounds the spring hub 134 and is disposed between the piston second section 122 and the above-mentioned adjustable spring retainer 136. The conical disc spring 106 may be implemented using a single conical disc spring or a plurality of conical disc springs 106. Moreover, depending on the desired characteristics to be achieved, if a plurality of conical disc springs 106 is used, the disc springs may be variously configured. For example, as FIGS. 2 and 3 depict, the plurality of conical disc springs may be stacked in parallel (FIG. 2) or series (FIG. 3). More specifically, parallel stacking of conical disc springs is used when increased spring forces for a given deflection are needed or desired, and series stacking of conical disc springs is used when increased deflections for a given force are needed or desired.

No matter the specific number and configurations used to implement the conical disc spring 106, the conical disc spring 106 supplies a preload force to the piston 104 that maintains the piston 104 in the first position until the media pressure applied to the piston 104 is of a sufficient magnitude that it supplies a force to the piston 104 that exceeds the preload force. The preload force supplied by the conical disc spring 106 to the piston 104 may be adjustably set via the adjustable spring retainer 136. To do so, the adjustable spring retainer 136 is movably disposed in the housing 102. It will be appreciated that the adjustable spring retainer 136 may be movably disposed in accordance with any one of numerous techniques, but is preferably disposed within the housing 102 via mating threads that are formed on the housing 102 and on the adjustable spring retainer 136. Thus, rotation of the adjustable spring retainer 136 relative to the housing 102 adjusts the preload force supplied from the conical disc spring 106 to the piston 104. The adjustable spring retainer 136 may also be used to adjust the spring force hysteresis, in conjunction with the selection of specific parameters and configurations of the conical disc spring 106, as will now be briefly discussed.

Figure 4:
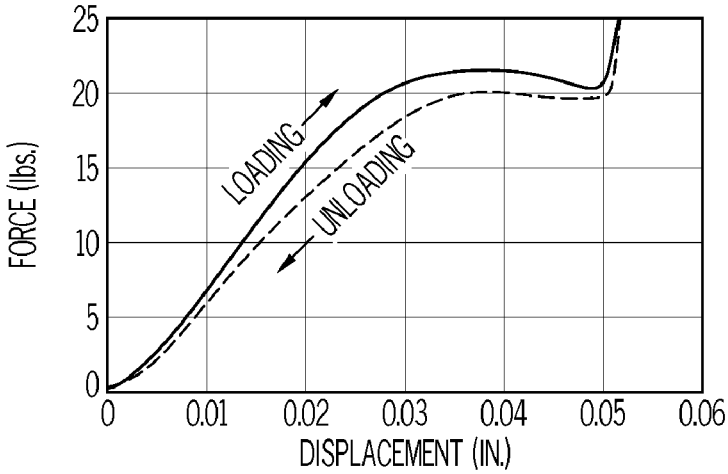
FIG. 4 is a graph depicting spring force hysteresis exhibited by an exemplary conical disc spring that may be used to implement the pressure switch of FIG. 1.

In addition to supplying the preload force and the nonlinear spring force versus deflection, the conical disc spring 106 exhibits a spring force hysteresis associated with movement of the piston 104 from the first position to the second position and from the second position to the first position. The spring force hysteresis exhibited by the conical disc spring 106 is, to be more precise, the difference in spring force (for a given deflection) from loading to unloading. As depicted more clearly in FIG. 4, such a spring force hysteresis results in a larger spring force (for a given deflection) during loading than during unloading. In the pressure switch 100, the exhibited spring force hysteresis may be varied based on the number and configuration of the conical disc springs 106. For example, the outer diameter, inner diameter, thickness, material of construction, and stacking configuration can be selected to not only attain desired force versus deflection characteristics, but to also attain a desired spring force hysteresis. Selection and adjustment of the spring force hysteresis provides for a more coarse selection and adjustment of the overall pressure switch hysteresis. A more fine adjustment of the overall pressure switch hysteresis is preferably provided via the adjustable differential switch 108, and embodiment of which will now be described.

Returning once again to FIG. 1, the adjustable differential switch 108 is disposed within the differential switch cavity 114, and engages at least a portion of the piston 104. The switch 108, which is depicted in simplified schematic form in FIG. 1, is movable between a first switch state and a second switch state. In particular, when the piston 104 moves from the first piston position to the second piston position, it concomitantly moves the switch 108 from the first switch state to the second switch state. Thereafter, if or when the piston 104 moves from the second piston position back to the first piston position, the switch 108 will concomitantly move from the second switch state to the first switch state. The specific configuration of the switch 108 may vary, and may be configured as any one of numerous resilient mechanical, electrical, magnetic, or optical switches.

Figure 5:
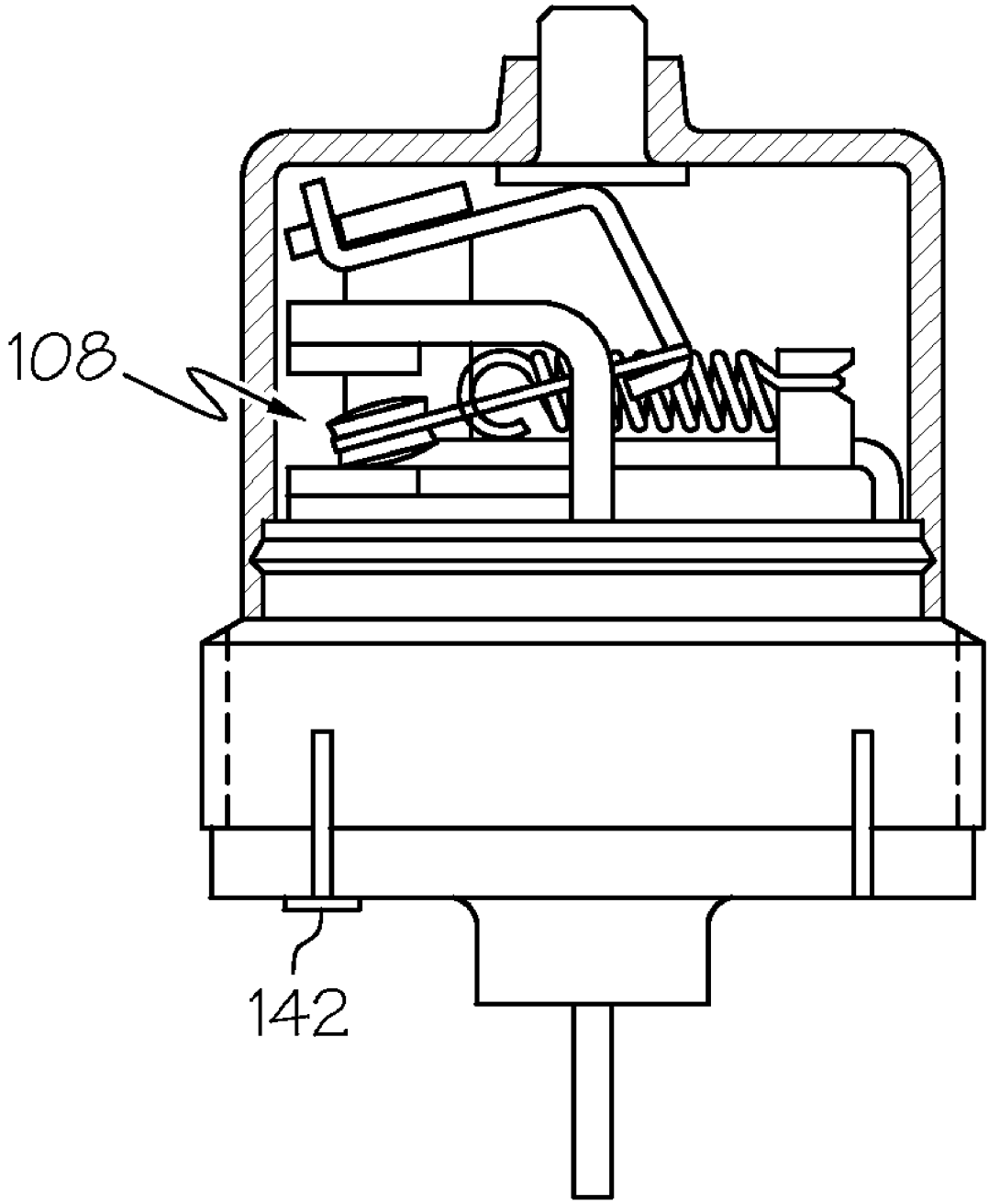
FIG. 5 depicts a simplified cross section view of an exemplary physical implementation of an adjustable differential switch mechanism that may be used to implement the pressure switch assembly of FIG. 1.

No matter the specific configuration and implementation, the switch 108, similar to the conical disc spring 106, is configured to also exhibit a switching hysteresis associated with movement from the first switch state to the second switch state, and from the second switch state to the first switch state. The switching hysteresis, which contributes to the overall pressure switch hysteresis, is also adjustable and, together with the spring force hysteresis, determines the above-mentioned set pressure value and also a reset pressure value of the pressure switch 100. The reset pressure value is the pressure at which at least the switch 108 moves back to the first switch state. Preferably, a switch adjustment mechanism 142 is coupled to the switch 108 to allow adjustment of the switching hysteresis. The switch adjustment mechanism 142, like the switch 108 itself, may vary in configuration. In one particular embodiment, in which the switch is implemented as a resilient mechanical miniature switch assembly, the switch adjustment mechanism is configured similar to a set screw. For completeness, a simplified cross section view of an exemplary physical implementation of an adjustable differential switch mechanism that may be used is depicted in FIG. 5.

With the above-described pressure switch configuration, when media pressure of a sufficient magnitude is applied to the piston 104, such that a force acts on the piston 104 that exceeds the preload force supplied to the piston 104 from the conical disc spring 106, the piston 104 will move away from the first position toward the second position. However, the non-linear spring force supplied from the conical disc spring 106 at least inhibits movement of the piston 104 to the second position until the media pressure is greater than or equal to the above-mentioned set pressure value. When the piston 104 begins moving toward the second piston position, or at some point while it is moving toward the second piston position, the piston 104 will begin urging the switch 108 from the first switch state toward the second switch state. Then, if or when the set pressure value is reached, the piston 104 will move the switch 108 from the first switch state to the second switch state. The switch 108 could be configured, when moved to the second switch state, to either complete or open a circuit to cause a desired end result. For example, it may cause an audible and/or visual warning, or cause a pump to energize or de-energize, or a valve to open or close, just to name a few examples. Thereafter, if or when the media pressure begins to subsequently decrease below the set pressure value, the piston 104 will begin moving back toward the first piston position. If or when the reset pressure value is reached, the switch 108 will move from the second switch state to the first switch state.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A pressure switch, comprising:

a housing having a piston cavity formed therein;

a piston movably disposed in the piston cavity, the piston movable, in response to a media pressure being applied to a surface thereof, between at least a first piston position and a second piston position;

a conical disc spring disposed in the housing and supplying a non-linear spring force to the piston that urges the piston toward the first position and at least inhibits movement of the piston to the second piston position until the media pressure is greater than or equal to a predetermined set pressure value, the conical disc spring further supplying a preload force to the piston when the piston is in the first position; and an adjustable spring retainer movably disposed within the housing, the adjustable spring retainer movable to a plurality of positions to thereby adjust the preload force supplied from the conical disc spring to the piston.

2. The pressure switch of claim 1, wherein the conical disc spring exhibits a spring force hysteresis associated with movement of the piston from the first piston position to the second piston position and from the second piston position to the first piston position.

3. The pressure switch of claim 2, wherein:

the adjustable spring retainer is movable to a plurality of positions to thereby adjust the spring force hysteresis exhibited by the conical disc spring.

4. The pressure switch of claim 1, further comprising:

a switch disposed within the housing and engaging at least a portion of the piston, the switch movable between a first switch state and a second switch state in response to movement of the piston between the first piston position and the second piston position, respectively.

5. The pressure switch of claim 4, wherein the switch exhibits a switching hysteresis associated with movement thereof from the first switch state to the second switch state and from the second switch state to the first switch state.

6. The pressure switch of claim 5, further comprising:

a switch adjustment mechanism coupled to the switch and operable to adjust the switching hysteresis that the switch exhibits.

7. The pressure switch of claim 6, wherein:

the conical disc spring exhibits a spring force hysteresis associated at least with movement of the piston from the first piston position to the second piston position and from the second piston position to the first piston position; and the adjustable spring retainer is movable to a plurality of positions to thereby adjust the spring force hysteresis exhibited by the conical disc spring.

8. The pressure switch of claim 7, wherein:

the pressure switch exhibits an overall pressure switch hysteresis representative of the combination of the spring force hysteresis and the switching hysteresis;

adjustment of the switching hysteresis supplies a fine adjustment of the overall pressure switch hysteresis; and adjustment of the spring force hysteresis supplies a coarse adjustment of the overall pressure switch hysteresis.

9. A pressure switch, comprising:

a housing having a piston cavity formed therein;

a piston movably disposed in the piston cavity, the piston movable, in response to a media pressure being applied to a surface thereof, between at least a first piston position and a second piston position; and a conical disc spring disposed in the housing and supplying a preload force to the piston when the piston is in the first piston position, the conical disc spring configured to exhibit a spring force hysteresis associated with movement of the piston from the first piston position to the second piston position and from the second piston position to the first piston position, and further configured to supply a non-linear spring force to the piston that:

(i) at least inhibits movement of the piston from the first piston position to the second piston position until the media pressure is greater than or equal to a predetermined set pressure value, and (iii) urges the piston toward the first piston.

10. The pressure switch of claim 9, further comprising:

an adjustable spring retainer movably disposed within the housing, the adjustable spring retainer movable to a plurality of positions to thereby adjust (i) the preload force supplied from the conical disc spring to the piston and (ii) the spring force hysteresis exhibited by the conical disc spring.

11. The pressure switch of claim 9, further comprising:

a switch disposed within the housing and engaging at least a portion of the piston, the switch movable between a first switch state and a second switch state in response to movement of the piston between the first piston position and the second piston position, respectively.

12. The pressure switch of claim 11, wherein the switch exhibits a switching hysteresis associated with movement thereof from the first switch state to the second switch state and from the second switch state to the first switch state.

13. The pressure switch of claim 12, further comprising:

a switch adjustment mechanism coupled to the switch and operable to adjust the switching hysteresis that the switch exhibits.

14. The pressure switch of claim 13, wherein:

the pressure switch exhibits an overall pressure switch hysteresis representative of the combination of the spring force hysteresis and the switching hysteresis;

adjustment of the switching hysteresis supplies a fine adjustment of the overall pressure switch hysteresis; and adjustment of the spring force hysteresis supplies a coarse adjustment of the overall pressure switch hysteresis.

15. A pressure switch, comprising:

a housing having a piston cavity formed therein;

a piston movably disposed in the piston cavity, the piston movable, in response to a media pressure being applied to a surface thereof, between at least a first piston position and a second piston position;

a switch disposed within the housing and engaging at least a portion of the piston, the switch movable between a first switch state and a second switch state in response to movement of the piston between the first piston position and the second piston position, respectively, the switch configured to exhibit a switching hysteresis associated with movement thereof from the first switch state to the second switch state and from the second switch state to the first switch state;

a spring disposed in the housing and supplying a preload force to the piston when the piston is in the first piston position, the spring further configured to supply a non-linear spring force to the piston that at least inhibits movement of the piston to the second piston position until the media pressure is equal to or greater than a predetermined set pressure value; and a switch adjustment mechanism coupled to the switch and operable to adjust the switching hysteresis that the switch exhibits.

16. The pressure switch of claim 15, wherein the spring exhibits a spring force hysteresis associated with movement of the piston from the first piston position to the second piston position and from the second piston position to the first piston position, and wherein the pressure switch further comprises:

an adjustable spring retainer movably disposed within the housing, the adjustable spring retainer movable to a plurality of positions to thereby adjust the spring force hysteresis exhibited by the spring.

17. The pressure switch of claim 16, wherein:

the pressure switch exhibits an overall pressure switch hysteresis representative of the combination of the spring force hysteresis and the switching hysteresis;

adjustment of the switching hysteresis supplies a fine adjustment of the overall pressure switch hysteresis; and adjustment of the spring force hysteresis supplies a coarse adjustment of the overall pressure switch hysteresis.

* * * * *